US005458332A

United States Patent [19]

Fisher

[11] Patent Number: 5,458,332

[45] Date of Patent: Oct. 17, 1995

[54] GOLF PUTTER HEAD WITH A CUSHIONING FACE

[76] Inventor: Dale Fisher, 18055 Bushard St., Fountain Valley, Calif. 92708

[21] Appl. No.: 416,135

[22] Filed: Apr. 4, 1995

Related U.S. Application Data

[63] Continuation-in-part of Ser. No. 236,583, May 2, 1994.

[51] Int. Cl.[6] ..... A63B 53/04

[52] U.S. Cl. ..... 273/78; 273/173; 273/DIG. 8

[58] Field of Search ..... 273/167 R, 167 A, 273/167 H, 167 J, 171, 172, 173, 174, 175, 78, 77 R, 164.1, 193 R, 194 R, 186.4, 187.4, 162 R, DIG. 8, DIG. 3, DIG. 10

[56] References Cited

U.S. PATENT DOCUMENTS

| | | | |
|---|---|---|---|
| 2,957,696 | 10/1960 | Warpotas | 273/164.1 |
| 3,211,455 | 10/1965 | Hyden | 273/173 |
| 3,815,910 | 6/1974 | Raines | 273/173 |
| 3,843,122 | 10/1974 | Florian | 273/173 |
| 3,937,474 | 2/1976 | Jepson | 273/DIG. 8 |
| 4,156,526 | 5/1979 | Huggins | 273/78 |
| 4,326,716 | 4/1982 | Lacoste | 273/DIG. 8 |
| 4,422,638 | 12/1983 | Tucker | 273/DIG. 8 |
| 4,679,792 | 7/1987 | Straza . | |
| 5,083,778 | 1/1995 | Douglas . | |

FOREIGN PATENT DOCUMENTS

| | | | |
|---|---|---|---|
| 376277 | 6/1932 | United Kingdom | 273/164.1 |
| 2124910 | 2/1984 | United Kingdom | 273/167 J |

*Primary Examiner*—Sebastiano Passaniti
*Attorney, Agent, or Firm*—Gary Appel

[57] ABSTRACT

A golf putter comprises a putter head having fixed thereto a putter shaft, the putter head having a front face into which is received and fixed a polyurethane insert or pad at the position of intended ball impact. The insert may be one of a set of inserts or pads, each of which is constructed from a solid polyurethane material having a pre-selected and reproducible linear relationship between its rebound factor and the distance to a target hole for any designated and pre-selected value of its hardness. For a particular hardness value, a number of pads having different specific rebound factors are manufactured. The rebound factors of each pad are substantially equal to a constant "$K_n$", where $K_1$=12.5%, $K_2$=25%, $K_3$=37.5%, and $K_4$=50.0%. A golfer may thus preselect a pad having a known characteristic related to the distance from a golf ball to a cup. The preselected pad provides a known cushioning feel effect and a relatively large contact area when a golf ball is putted by the putter, the cushioning effect factor of the putter head thus advantageously diminishing club head oscillation or quivering and dampening the putter head force transmitted from the hand grip area through the putter shaft. For such purpose, the pad has a hardness that is between about Shore A 70 and about Shore D 80 durometer, the hardness of a typical golf ball being in excess of Shore A 100 durometer. Alternatively, a set of putters is provided, and each putter head has a front face which is formed from, or includes, such a pad. In either case, the pad includes an indicator which, as viewed from above, indicates the center of the pad so as to aid the user in aligning the putter head with a golf ball.

11 Claims, 3 Drawing Sheets

GOLF PUTTER HEAD WITH A CUSHIONING FACE

This is a continuation-in-part of application Ser. No. 08/236,583 filed May 2, 1994 and now copending.

BACKGROUND OF THE INVENTION

1. Field of the Invention

The present invention relates generally to the field of sporting equipment, more particularly to golf clubs, and still more particularly to golf putters.

2. Background Discussion

Most golfers are likely to agree that putting is a very difficult and frustrating part of the game of golf. In fact, as Sunday TV viewers can testify, most golf tournaments are won or lost on the putting greens. It is particularly frustrating on a par 3 hole to get on the green with one stroke and then take four strokes to get the ball in the cup.

That the putting phase of the golf game is difficult and frustrating to most golfers is evidenced by the large variety of golf putters that are on the market. In the course of several years of playing golf, a typical golfer may have at most two sets of golf clubs, but may have as many as four or five putters. After a particularly bad day on the greens, an old putter may be discarded in favor of a new putter that the golfer thinks may improve his or her greens game.

Also, more so than regular golf clubs, putters tend to be more personalized to a golfer-they may be given names and may be talked to even.

One difficulty with a greens game is that putting distances may vary greatly from twenty or thirty feet to a only few inches. Long putting distances require a hard hit ball to make the ball travel the distance, and short putting distances require a softly hit ball.

It can thus be appreciated that like the driving portion of the golf game that often requires the use of several different clubs with different face slants and weights, a good greens game can require the use of more than one putter to gain a competitive advantage—at least a long distance putter and a short distance putter. Each of such kinds of putters can be expected to have different features just as different driving clubs have different features tailored to particular types of situations and lay of the golf ball.

Various patents have been granted for different types of golf putters. For example, U.S. Pat. No. 4,422,638 to Tucker discloses a metal golf putter head to which can be attached a plastic face that is intended to provide a greater rebound of a hit golf ball than the metal club itself, i.e., a face having a rebound factor in excess of 50%, with greater than 60% preferred. U.S. Pat. No. 5,083,778 to Douglas discloses a golf putter having a resilient, laminated plastic at the face of a metal club. The inner layer of the insert is disclosed as having a hardness less than the outer layer which has a hardness equal to or greater than the hardness of golf balls. The disclosed intent is to apply a small contact area to a putted golf ball.

U.S. Pat. No. 4,679,792 to Straza, et al., discloses a metal golf putter head having an epoxy-filled honeycomb striking face with open ends of the honeycomb facing a ball to be putted, the expressed intent being to provide a resilient impact surface that will impart increased momentum to a putted ball while requiring only a short back swing.

The present Inventor considers that all heretofore known golf putters have some disadvantages, a common disadvantage often being that a putted ball is given too much momentum and thus poor control over short putting distances. The Inventor considers that instead of a relatively "soft" stroke imparting substantial momentum to a putted ball, it is more advantageous during short putts for a putter head to be relatively "dead" so that the individual does not have to pull his or her stroke to keep from overdistancing the ball.

Additionally, a typical golfer will normally prefer a more active feel to his putter as his skill improves with time. In other words, a neophyte or unskilled golfer tends to be more comfortable with a longer duration of contact between the ball and the club on impact, so that he experiences a sensation of substantial traction, while an accomplished professional golfer prefers a harder, more positive "feel" when his club head strikes the ball. Not surprisingly, a golfer of intermediate skill would choose a club head hardness in between "high traction"0 and "live contact".

None of the prior art patents disclose chemically compounding the club head material to adjust rebound factor while maintaining a fixed level of hardness.

For these and other reasons, the present Inventor has invented an improved golf putter cushioned head designed to be used either interchangeably in a single putter, or to be fixed in a putter that is one of a set of such putters, each of which heads is considered to provide excellent golfer-selected control and feel of the ball for a particular golfer and tailored to a specific range of putting distances.

SUMMARY OF THE INVENTION

In accordance with the present invention there is provided a golf putter comprising a putter head having fixed thereto a putter shaft. The putter head has a front face formed from or including a polymeric material based on, for example, a Uniroyal polyurethane as formulated by the Bailey-Parks Company of Memphis, Tenn. Contact with a golf ball is made by such a solid pad located at the position of intended ball impact (i.e., the "sweet spot"), the plastic pad having a hardness that may be less than the hardness of conventional golf balls, the pad having a resilience and thickness that provides a pre-selected cushioning effect when a golf ball is impacted by the putter head.

The polyurethane material of the pad is compounded to exhibit a direct relationship between the rebound factor of the pad and the distance to the hole (putting distance). At the same time, a particular pad or set of pads of varying rebound factors will have one of a range of different hardnesses chosen by the individual golfer from a range of hardnesses to suit the golfer's "feel" preference. As material composition changes in hardness (for different golfers), the pad material is chemically compounded to assure that the rebound factor remains a constant "$K_n$", where "n" is associated with a particular distance to a target hole. $K_n$ may generally cover a hardness range of about Shore A 65 durometer to about Shore D 80 durometer. For the material of the present embodiment, the values of $K_n$ are approximately $K_1$=12.5%, $K_2$=25.0%, $K_3$=37.5%, and $K_4$ =50.0%.

In accordance with a preferred embodiment of the invention, the front face of the putter head is formed having a recess, the pad being mounted or installed in such recess as an insert whereby the top of the pad is viewed from above. Alternatively, the face of the putter head itself may be formed of the polyurethane material.

Preferably for most golfers, the pad has a Shore A durometer hardness substantially less than the Shore A 100+ hardness of typical golf balls. For an average ability golfer, the pad may have a hardness of Shore A 85 durometer. A variety of pads having different specific rebound values, but having the same hardness, as personally preferred by the particular golfer, may be selected, each pad being adapted for a particular different putting distance. A more experienced golfer, say, on a professional level, may prefer a hardness of Shore D 50 to 70 durometer to satisfy his or her personal preference for feel and control.

Alternatively, a set of multiple putters may be provided to serve the same purpose. In either case, the pads employed may be color coded to identify and distinguish one from another.

In further accordance with a preferred embodiment of the invention, the pad includes an indicator indicating the center of the pad when viewed from above, thereby indicating to the user the center of the "sweet spot."

The design characteristics of the pad provide a controlled pre-selected cushioning effect when the putter head impacts a golf ball and thereby predictably reduces the rolling distance of a putted golf ball as compared to the distance that the ball would roll using conventional metal putters. By reducing the roll of the putted ball, the putter of the present invention enables a more natural putter swing instead of a "choked" swing ordinarily required for short putts as when using conventional hard putters. Moreover, the cushioning effect of the polyurethane pad provides absorption of kinetic energy as the putter face strikes the golf ball, resulting in less putter head movement, oscillation or quivering upon impact. Additionally, this cushioning effect provides a greater contact area with the putted golf ball, increasing the area of the "sweet spot" and providing good ball control and feel as compared with the use of a metal putter head which provides essentially a variable point contact with a putted ball, because of the indentations on a standard golf ball.

BRIEF DESCRIPTION OF THE DRAWINGS

The present invention can be more readily understood by a consideration of the following detailed description when taken in conjunction with the accompanying drawings, in which.

In the various FIGS. identical elements and features are given the same reference number.

DETAILED DESCRIPTION OF AN EXEMPLARY EMBODIMENT

Figure 1:
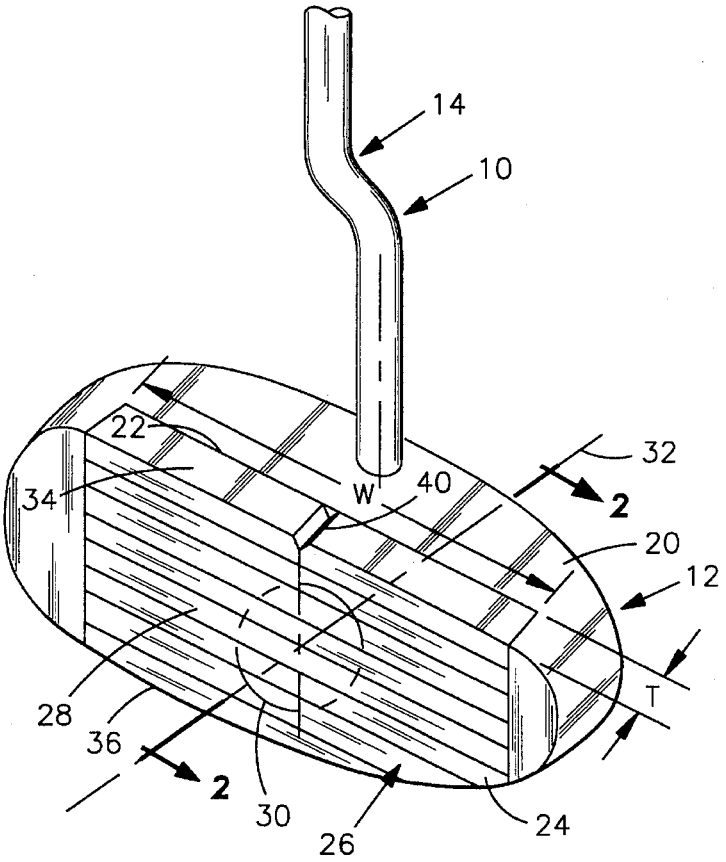
FIG. 1 is a perspective drawing of a cushion impact golf putter in accordance with an embodiment of the present invention, showing a putter head with a shaft attached thereto and showing a solid polyurethane pad inset into the face of the putter head.
Figure 2:
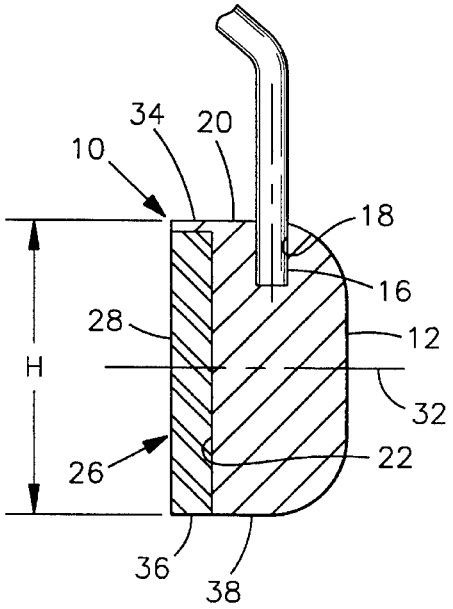
FIG. 2 is a transverse cross sectional drawing taken along line 2—2 of FIG. 1 showing features of the golf putter head.

There is shown in FIG. 1 a cushion impact golf putter 10 in accordance with the present invention. Comprising golf putter 10 are a putter head 12 and a putter shaft 14, only lower regions of which are shown. A lower end 16 of putter shaft 14 is received in a recess 18 formed downwardly from an upper surface 20 of putter head 12 (FIG. 2) and is retained therein by conventional means, such as soldering, brazing and/or staking.

Inset into a rectangular recess 22 formed rearwardly into putter head 12 from a forward face 24 thereof is a flexible polyurethane pad insert 26 having a golf ball impacting forward surface 28. Recess 22, and hence inserted pad 26, are centered, as shown in FIG. 1, about a predetermined "sweet spot" 30 which is on a transverse axis 32 of putter head 12.

Pad or insert 26 preferably has a width, W, (FIG. 1) of about two inches and has a height, H, (FIG. 2) that is preferably the same height as putter 24. Upper and lower edges 34 and 36 (FIG. 2) of insert 26 are contoured the same as putter head upper surface 20 and a lower surface 38 thereof. Front face 24 of putter head 12 is preferably flat, as is front surface 28 of insert 26. Alternatively, front surface 28 of insert 26 may be slightly concave so as to form somewhat of a shallow pocket for centering a golf ball.

In addition, pad or insert 26 preferably has a thickness, T, (FIG. 1) that is about one-eighth (⅛) inch. Pad 26 is constructed from solid polyurethane having a hardness that is selected according to a golfer's preference. Current technology is able to produce polyurethane as soft as about 25 as measured by the Shore A test, to as hard as about 80 by the Shore D test. In an exemplary embodiment of the present invention, the material of pad 26 has a hardness in the range of Shore A 70 durometer to Shore D 80 durometer, selected to provide desirable feel to the individual golfer.

To adjust for different putting distances, different pads of the same hardness provide a decrease in rebound by energy absorption between club head 12 and ball 50 of substantially less than one hundred percent of an ideally "live" standard, and preferably in the range of 12.5% to 50.0% of the ideal. In that regard, the Inventor has determined that for a particular pad durometer reading, a rebound factor of about 25 percent is desirable for a medium putt. Furthermore, a 50.0% rebound factor is desirable for long putts, and a rebound factor of 12.5% is desirable for short putts. Examples of rebound values attained by present manufacturing methods are the following existing Bailey-Parks compounds and their corresponding rebound factors: BP 602-80A at 52%; BP625-85A at 59.5%; and BP9085-85A at 47%. The lower rebound factors are attainable for similar hardness values as required, unlike previous plastic material used for putter faces, such as DuPont Hytrel, wherein the rebound factor is not adjustable for a particular hardness. The rebound factors are directly related to the distance to the hole, or target, as is clearly illustrated in the plot of rebound factor versus putting distance presented in FIG. 6, and discussed below.

Preferably, pad 26 is constructed having a indicator 36 (FIG. 1) at upper surface 34 thereof. Indicator 36 may be a narrow, V-shaped groove, as shown, or may be a projection or colored line or dot that is located directly above axis 32 to guide a user in the alignment of putter head 12 with a golf ball 50 (FIGS. 3 and 4) to be impacted by putter 10.

Figure 3:
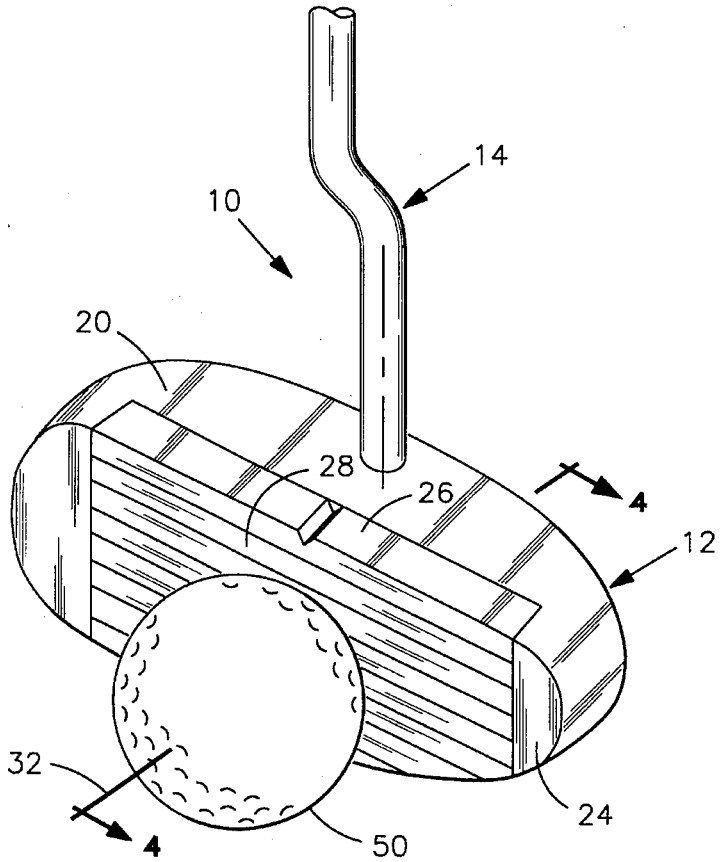
FIG. 3 is a perspective drawing similar to FIG. 1 showing the putter head of the present invention impacting a golf ball.
Figure 4:
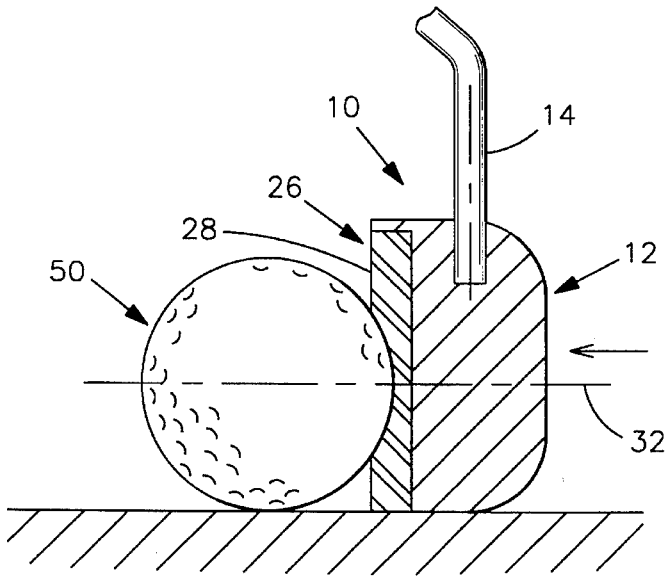
FIG. 4 is a transverse cross sectional drawing taken along line 4—4 of FIG. 3 and similar to FIG. 2, except showing the solid polyurethane pad deformed by impact with the golf ball.

In use, as depicted in FIGS. 3 and 4, and especially in FIG. 4, when golf ball 50 is struck by front face 28 of pad 26, the ball causes a pre-determined compression of the insert at the region of impact depending upon the desired rebound factor. Because of the resilience of insert 26, some of the impact energy is absorbed by deformation of pad 26 so that golf ball 50 is driven a shorter distance, with consequent greater control of direction and roll, than would otherwise be the case with heretofore known putters. This enables a user to give putter 10 a reasonable swing without fear of over-driving the ball. As was previously pointed out, this is beneficial since a very short stroke of a putter is more difficult to control.

Depending upon the distance of the golf ball from the cup (not shown) and the degree of control and feel required to sink the putt, the golfer can preselect a pad 26 from a set of pads to be inserted in a putter 10, (or, from a multi-putter set of putters embodying the present invention, may select a putter) for, say, a 12.5%, 25%, 37.5%, or 50.0% rebound factor. In either case, the pads 26 may be color coded for ease of identifying the pad to the distance.

Figure 5:
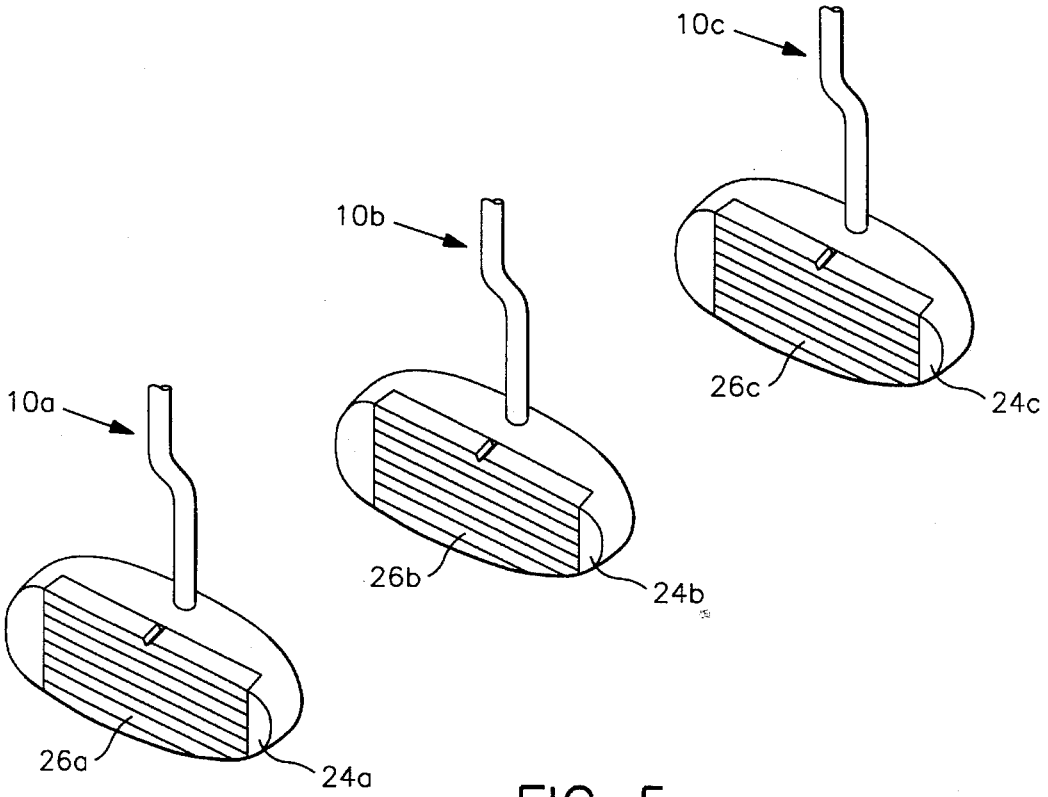
FIG. 5 is a perspective drawing of a plurality of putters embodying the principles of the present invention.

FIG. 5 illustrates such a set of putters 10*a* through 10*b*. Three putters are used for purpose of illustration only, and no limitation on the number of such putters in a set is intended. Each of the putters (e.g., 10*a*) has a pad (e.g., 26*a*) attached to or forming its putter face (24*a*), which pad has a different rebound value from each of the other pads according to putting distance, but is formulated so that all of the pads 10*a*–10*c* have the same hardness as desired by a particular golfer.

Figure 6:
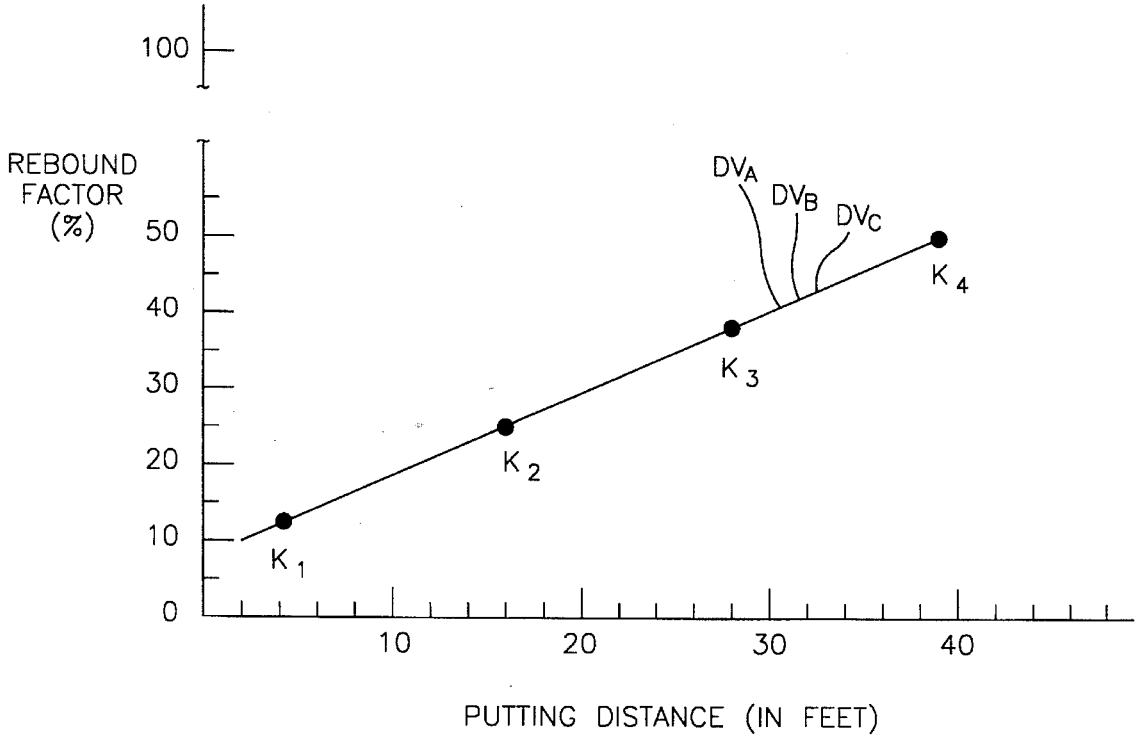
FIG. 6 is a graphical presentation of Rebound Factor versus Putting Distance for the polyurethane pad of FIGS. 1 through 5.

The distance-rebound factor spectrum of the pads 26 is graphically illustrated in FIG. 6. For a given hardness of the pad 26 material, a rebound factor is associated with a putting distance: a short putting distance requires a "deader" pad, i.e., a lower rebound factor. Three co-linear lines represent the values of hardness or durometer value (DV) illustrated in FIG. 6 for purposes of one exemplary embodiment of this invention, by $DV_A$, $DV_B$ and $DV_C$, covering the range of hardness from 70A durometer to 80D durometer. As can be seen from FIG. 6, the rebound factor RF remains a constant "$K_n$" for a particular value of putting distance even as hardness values (DV) change.

Because of the resilience of insert 26, putter 10 preselected with its particular cushioning effect is more "forgiving" in that an unintended stroke that is too strong, while it may cause ball 50 to miss the cup, will not tend to cause the ball to miss the cup by much, thereby making the holing of the ball more certain on the next stroke. For such reasons, also as previously mentioned, putter 10 is particularly advantageous for short distance putting.

Additionally, because of the cushioning effect of insert pad 26 relative to that of golf ball 50, a relatively large contact area is provided between the insert and the golf ball, thereby providing less chance that the ball will be putted in an off-line direction, such as may be the situation when a ball is putted by a hard putter head that provides only a small or point contact area impact area. Consequently, a larger than normal sweet spot is provided by putter head 12, as is greater directional feel and control of the putted golf ball 50.

Moreover, the polyurethane pad provides a reduction in club head quivering on impact, further enhancing positive contact of the putted ball. Recent improvement to clubs of many manufacturers (e.g. Lynx, Calloway, Cleveland, etc.) have employed polyurethane rings and decals on the back of putter heads or in the shaft to reduce vibration. The present invention features oscillation damping at the point of contact with the ball, namely, at pad 26, to diminish another of the variables that contribute to misdirection of the putted ball.

Although there has been described and illustrated an improved golf putter, especially for short putting distances, for purposes of illustrating the manner in which the invention may be used to advantage, the invention is not limited thereto. Therefore, any and all variations and modifications that may occur to those skilled in the applicable art are to be considered as being within the scope and spirit of the claims as appended hereto.

What is claimed is:

1. A cushioned golf putter head having an intended golf ball impact region, said head comprising a resilient pad formed from a polymeric material having one of a first plurality of hardness or durometer values (DV), said material exhibiting one of a second plurality of rebound factors (RF) for each said hardness value, each of said rebound factors being less than 50.0% in amount, and said pad formulated to effect a reproducible direct linear relationship between said rebound factor and the distance from said putter head to an intended target.

2. The cushioned head of claim 1 wherein said pad includes an indicator indicating the center of the pad and thereby the center of said impact region.

3. A golf putter comprising:

a. a putter head having a front face with an intended golf ball impact region;

b. an elastomeric pad formed from a polyurethane material having a linear relationship between the rebound factor (RF) thereof and the distance from said putter head to an intended target for a durometer range of at least between about Shore A 70 and about Shore D 80, the rebound factor for any durometer value being substantially equal to a constant, $K_n$;

c. means for attaching said pad to said putter face at said intended impact region; and d. a putter shaft fixed to said putter head.

4. The golf putter as claimed in claim 3, wherein said constant, $K_n$, of the pad has the approximate values $K_1$=12.5%, $K_2$=25% $K_3$=37.5%, and $K_4$=50.0%.

5. A golf putter comprising:

a. a putter head having a front face with an intended golf ball impact region;

b. a plurality of elastomeric pads, each of said pads being formed from a polyurethane material having a linear relationship between the durometer value (DV) and rebound factor (RF) thereof and the distance from said putter head to an intended target for a durometer range of at least between about Shore A 70 and about Shore D 80, the rebound factor for any durometer value being substantially equal to a constant, $K_n$;

c. means for releasably attaching a selected one of said pads to said putter face at said intended impact region; and d. a putter shaft fixed to said putter head.

6. The golf putter as claimed in claim 5, wherein said constant, $K_n$, of the pad has the approximate values $K_1$=12.5%, $K_2$=25%, $K_3$=37.5% and $K_4$=50.0%.

7. A golf putter comprising:

a. a putter head having a front face with an intended golf ball impact region;

b. a plurality of polymeric pads, each of said pads being formed from a polyurethane material having a linear relationship between the durometer value (DV) and rebound factor (RF) thereof and the distance from said putter head to an intended target for a durometer range of at least between about Shore A 70 and about Shore D 80, the rebound factor for any durometer value being given by $K_n$, where $K_n$ is approximately equal to the values for each said distance of $K_1$=12.5%, $K_2$=25%, $K_3$=37.5%, and $K_4$=50.0%;

c. means for releasably attaching any selected one of said pads to said putter face at said intended impact region;

and d. a putter shaft fixed to said putter head.

8. A series of golf putters, each of said putters comprising:

a. a putter head having a front face with an intended golf ball impact region;

b. a pad formed of a polyurethane material, said pad being disposed at said intended impact region of said putter face and having a different rebound value with respect to each other pad included in said putters, each said rebound value being related to a particular different putting distance from a target, such that each said pad has a linear rebound value relationship relative to each said other pad.

9. The golf putters of claim 8, wherein said pad forms said putter face.

10. The golf putter as claimed in claim 8, wherein said pad includes an indicator indicating the center of the pad and thereby the center of said impact region.

11. A series of golf putters, each of said putters having a polyurethane pad forming a front face on each of said putters wherein each said pad is formulated to effect a pre-selected and reproducible rebound, said rebound being related to the distance from each said face to an intended target by a linear relationship.

* * * * *